US012642338B2

(12) United States Patent
Wang

(10) Patent No.: US 12,642,338 B2
(45) Date of Patent: Jun. 2, 2026

(54) AIR OUTLET ASSEMBLY AND ELECTRIC HAIR DRIER

(71) Applicant: FOSHAN SHUNDE LEITAI ELECTRIC APPLIANCE MANUFACTURING CO., LTD., Guangdong (CN)

(72) Inventor: Rui Wang, Fujian (CN)

(73) Assignee: FOSHAN SHUNDE LEITAI ELECTRIC APPLIANCE MANUFACTURING CO., LTD., Foshan (CN)

( * ) Notice: Subject to any disclaimer, the term of this patent is extended or adjusted under 35 U.S.C. 154(b) by 783 days.

(21) Appl. No.: 18/002,516

(22) PCT Filed: Dec. 28, 2021

(86) PCT No.: PCT/CN2021/141890
§ 371 (c)(1),
(2) Date: Dec. 20, 2022

(87) PCT Pub. No.: WO2023/050616
PCT Pub. Date: Apr. 6, 2023

(65) Prior Publication Data

US 2024/0115026 A1 Apr. 11, 2024

(30) Foreign Application Priority Data

Sep. 30, 2021 (CN) ..... 202111165193.2
Sep. 30, 2021 (CN) ..... 202122403575.6

(51) Int. Cl.
*A45D 20/12* (2006.01)

(52) U.S. Cl.
CPC ..... *A45D 20/12* (2013.01)

(58) Field of Classification Search
CPC ..... A45D 20/12
(Continued)

(56) References Cited

U.S. PATENT DOCUMENTS 5,568,691 A * 10/1996 Rubin ..... A45D 20/30 392/380
5,642,570 A * 7/1997 Lee ..... B05B 7/2416 34/98
(Continued)

FOREIGN PATENT DOCUMENTS

CA 3119244 A1 * 5/2022 ..... H05K 7/20145
CN 103355930 A 10/2013
(Continued)

*Primary Examiner* — Stephen M Gravini

(57) ABSTRACT

The present disclosure provides an air outlet assembly, including a shell assembly, a first air guide device is arranged inside the mounting cavity of the shell assembly and provided with an air passing cavity, a second opening and a third opening are formed in the first air guide device; at least a part of a second air guide device stretches into the air passing cavity of the first air guide device, one section that the second air guide device stretches into the air passing cavity is a first air guide section, and one section that the second air guide device is located outside the first air guide device is a second air guide section; and a motor device stretches into the air passing cavity from the third opening, and at least a part of the motor device is arranged in the air passing cavity.

8 Claims, 10 Drawing Sheets

(58) Field of Classification Search
USPC ..... 34/97
See application file for complete search history.

(56) References Cited

U.S. PATENT DOCUMENTS

| | | | | |
|---|---|---|---|---|
| 6,925,729 | B2 * | 8/2005 | Sullivan | A45D 20/12 34/97 |
| 9,144,286 | B2 * | 9/2015 | Courtney | A45D 20/12 |
| 9,414,662 | B2 * | 8/2016 | Moloney | A45D 20/00 |
| 9,441,885 | B2 * | 9/2016 | Bayley | F26B 21/12 |
| 11,253,039 | B1 * | 2/2022 | Lei | A45D 20/12 |
| 11,365,509 | B2 * | 6/2022 | Hull | H02K 16/00 |
| 11,622,611 | B2 * | 4/2023 | Depoyian | A45D 20/12 34/97 |
| 12,383,040 | B2 * | 8/2025 | Lin | H02P 6/04 |
| 12,389,995 | B2 * | 8/2025 | Oikaze | B05B 12/08 |
| 2024/0115026 | A1 * | 4/2024 | Wang | A45D 20/12 |

FOREIGN PATENT DOCUMENTS

| | | | | |
|---|---|---|---|---|
| CN | 207767753 | U | 8/2018 | |
| CN | 108887852 | A | 11/2018 | |
| CN | 109700159 | A | 5/2019 | |
| CN | 109998258 | A | 7/2019 | |
| CN | 110419842 | A | 11/2019 | |
| CN | 211298730 | U | 8/2020 | |
| CN | 211747557 | U | 10/2020 | |
| CN | 211882644 | U | 11/2020 | |
| CN | 213045840 | U | 4/2021 | |
| CN | 213908938 | U | 8/2021 | |
| CN | 113749375 | A | 12/2021 | |
| CN | 217959111 | U | 12/2022 | |
| EP | 3995032 | A1 * | 5/2022 | H05K 7/20145 |
| JP | 2004357763 | A | 12/2004 | |
| JP | 2018175575 | A | 11/2018 | |
| JP | 2022076992 | A * | 5/2022 | H05K 7/20145 |
| WO | WO-2023050616 | A1 * | 4/2023 | A45D 20/10 |

* cited by examiner

AIR OUTLET ASSEMBLY AND ELECTRIC HAIR DRIER

CROSS-REFERENCE TO RELATED APPLICATION

The present disclosure claims priority to Chinese patent application No. 202111165193.2, filed on Sep. 30, 2021 and entitled "Air Outlet Assembly and Electric Hair Drier" and Chinese patent application No. 202122403575.6, filed on Sep. 30, 2021 and entitled "Air Outlet Assembly and Electric Hair Drier", the disclosure of which is incorporated by reference herein in its entirety as part of the present application.

TECHNICAL FIELD

The present disclosure relates to the technical field of household appliances, in particular to an air outlet assembly and an electric hair drier.

BACKGROUND

At present, most of common electric hair drier products can dry hair at low speed blowing, with low wind speed and wind pressure, slow speed for drying hair and low motor speed; namely, the electric hair drier is composed of a DC zero motor and common blades, and a whole air outlet duct cannot be formed. In addition, partial high-speed electric hair drier products appear on the market, with a motor speed of reaching 110,000 RPM, a wind speed of above 20 m/s, quick hair drying speed and wider scope of application; and however, the high-speed electric hair drier product has the disadvantages of complicated product assembly, high cost and difficult promotion.

SUMMARY

An air outlet assembly, including a shell assembly, a first air guide device, a second air guide device and a motor device, wherein a mounting cavity is arranged inside the shell assembly, a first opening is formed in the shell assembly, and the first opening is communicated with the mounting cavity; the first air guide device is arranged inside the mounting cavity and provided with an air passing cavity, a second opening and a third opening are formed in the first air guide device, and the second opening and the third opening are communicated with the air passing cavity; at least a part of the second air guide device stretches into the air passing cavity of the first air guide device, one section that the second air guide device stretches into the air passing cavity is a first air guide section, a first air guide channel is formed between the first air guide section and an inner wall of the first air guide device, the second air guide device stretches to one end away from the second opening, one section that the second air guide device is located outside the first air guide device is a second air guide section. an air passing channel is formed between the second air guide section of the second air guide device and the shell assembly, the air passing cavity is communicated with the air passing channel through the second opening, the first opening is located at one side, away from the first air guide device, of the second air guide device, the second air guide section stretches to the first opening, an air outlet is formed between the second air guide section and a side wall of the shell assembly, and then the air outlet is located at one side away from the first air guide section; and the motor device stretches into the air passing cavity from the third opening, at least a part of the motor device is arranged in the air passing cavity, and the motor device is configured to generate airflow towards the second opening from the third opening.

The present disclosure provides an air outlet assembly, the shell assembly is provided with the air outlet, which is communicated with the mounting cavity in the shell assembly; the first air guide device is arranged in the mounting cavity and provided with the air passing cavity, the second opening and the third opening are formed in the first air guide device and communicated with the air passing cavity, External air reaches the air passing cavity through the second opening of the first air guide device and then flows into the air passing channel formed between the second air guide device and the shell assembly through the third opening of the first air guide device, and the air passing channel is formed between the second air guide device and the shell assembly, so that the air flowing through the inside of the first air guide device may be diffused to the air passing channel well. Since a cross section area of the second air guide device is gradually increased along a direction away from the first air guide device, the flowing air is gradually extruded, so as to form strong air pressure, the airflow is blown out through the air outlet formed between the second air guide section and the side wall of the first opening of the shell assembly, the air blown from the air passing cavity of the first air guide device performs circumferential movement inside the shell assembly, and air supply and suction are carried out continuously at the same time, thereby forming uninterrupted high-pressure airflow for continuous supply. Further, through a specific shape setting of an air channel, the airflow may be guided and discharged after being intensively collected, so as to improve an air inlet efficiency. The airflow has a lower flow loss, so an air volume is improved, thereby implementing different speeds of a fluid in the air duct, adequately reducing the air volume at different positions, improving the air feeding effect and forming a high-pressure airflow for continuous supply.

In one embodiment, a width of the air outlet is greater than 1.0 mm. In the above embodiment, the width of the air outlet is greater than 1.0 mm for better air discharge.

Preferably, the width of the air outlet is 2-3 mm.

In one embodiment, the second air guide device is horn-shaped. Further, the second air guide device may be horn-shaped for better concentrated and guided discharge of the airflow.

In one embodiment, the first air guide section and the second air guide section of the second air guide device are enclosed to form the air guide section around an axis, and a cross section area of the second air guide device is gradually increased along a direction away from the first air guide device.

In one embodiment, the second air passing channel is formed by the air passing cavity of the first air guide device, the second opening and the third opening.

In one embodiment, a radial size of the second air passing channel is 18-55 mm.

In one embodiment, an axial size of the second air passing channel is 3-140 mm.

In one embodiment, a length of the second air guide device stretching to the second air passing channel of the first air guide device is 0-90 mm.

In one embodiment, the first air guide device includes an air guide member and a connector, the air guide member is arranged on the connector, the connector is arranged on the shell assembly, a first through hole is formed in the air guide member, a second through hole is formed in the connector, and the first through hole is communicated with the second through hole in turn so as to form the air passing cavity. In the above embodiment, the air volume of the airflow flowing into the first air guide device may be adequate.

In one embodiment, the motor device is located in the second through hole, one end of the motor device resists to an inner wall of the connector, and the other end of the motor device resists to the air guide member. In the above embodiment, the motor device may apply the air pressure to the airflow entering the air guide member well, so that airflow speed passing through connector and the air guide member may be higher, and the flowing speed is smoother.

In one embodiment, the air guide member includes an air guide member main body and a first mounting member, the first mounting member is arranged around the air guide member main body, the air guide main body stretches into the second through hole, and the first through hole is formed in the air guide member main body. In the above embodiment, the flowing airflow may be transmitted well, so as to ensure the maximum airflow.

In one embodiment, the connector includes a connector main body and a second mounting member, the second through hole is formed in the connector main body, at least a part of the air guide member stretches into the second through hole, the second mounting member is arranged on the connector main body, and the second mounting member is connected to the shell assembly. In the above embodiment, the flowing airflow may be transmitted well, so as to ensure the maximum airflow.

According to a second aspect, the embodiment of the present disclosure provides an electric hair drier, including an air outlet assembly, a heating device, a control device, a handle portion and a power switch, wherein a shell assembly includes an air outlet shell assembly and an air inlet shell assembly, the air outlet shell assembly is connected to the air outlet shell assembly, and the air outlet shell assembly and the air inlet shell assembly are enclosed to form a mounting cavity; the heating device is arranged on a second air guide device and located between the second air guide device and the shell assembly; the control device is electrically connected to a motor device and the heating device; and the handle portion is connected to the shell assembly, the power switch is arranged on the handle portion, and the power switch is electrically connected to the control device.

The present disclosure provides an electric hair drier, including an air outlet assembly, wherein the shell assembly includes an air outlet shell assembly and an air inlet shell assembly, and the air outlet shell assembly is connected to the air inlet shell assembly to form the mounting cavity and a channel, through which the airflow can flow. The heating device is arranged on the second air guide device and located between the second air guide device and the shell assembly, and the heating device is configured to heat the air flowing through the air passing channel.

Further, a plurality of heating devices are provided and arranged at intervals, a radial end of each heating device is embedded with a first mounting gap and/or a second mounting gap, the air of the motor device may be blown to the heating device or other components by using a structure inside the heating device, thereby achieving temperature reduction and noise reduction well.

Further, a plurality of division plates are arranged on the second air guide device, the plurality of division plates are arranged at intervals, mounting grooves are formed in the plurality of division plates, and the heating devices are arranged on the mounting grooves.

The control device is arranged in a containing cavity, and the control device is electrically connected to the motor device, so as to realize automation well. The electric hair drier further includes a handle portion and a power switch, the handle portion is connected to the shell assembly, the power switch is arranged on the handle portion, and the power switch is electrically connected to the control device. In the above embodiment, the electric hair drier further includes a handle portion and a power switch, the handle portion is connected to the shell assembly, the power switch is arranged on the handle portion, and the power switch is electrically connected to the control device. The automation and fetching and using through the handle may be achieved well.

Further, the air outlet shell assembly includes a first shell assembly and a second shell assembly, the second shell assembly is sleeved on the first shell assembly, the heating device is located between the second air guide device and the first shell assembly, and the second shell assembly is made of thermal insulation materials or the thermal insulation materials are coated on the second shell assembly.

BRIEF DESCRIPTION OF THE DRAWINGS

The drawings, which constitute a part of the present disclosure, are used to provide a further understanding of the present disclosure, and the exemplary embodiments of the present disclosure and the description thereof are used to explain the present disclosure, but do not constitute improper limitations to the present disclosure.

To better clarify the technical solution in the embodiment of the present disclosure, the drawings required to illustrate the embodiments will be simply described below. It is apparent that the drawings described below merely illustrate some embodiments of the present disclosure. Those of ordinary skill in the art can obtain other drawings without creative labor on the basis of those drawings.

Figure 1:
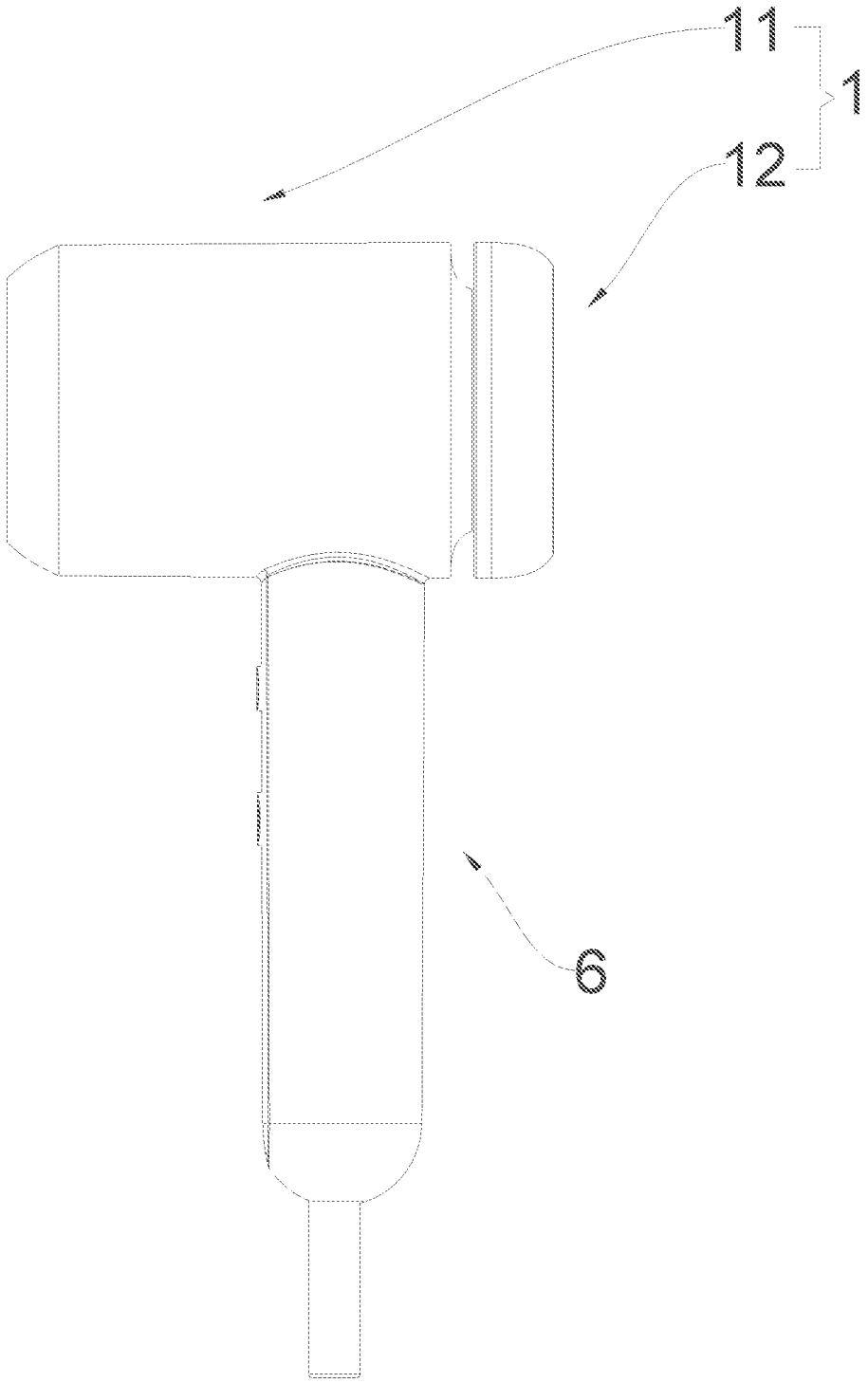
FIG. 1 is a front view of an electric hair drier of the present disclosure.

Wherein the corresponding relation between the reference signs and the component names is as follows:

1. Shell assembly; 11. Air outlet shell assembly, 12. Air inlet shell assembly; 105. Mounting cavity;

2. First air guide device, 21. Air guide member, 211. Air guide member main body, 212. First mounting member, 22. Connector, 221. Connector main body, 222. Second mounting member, 223. Gap, 204. Second air passing channel; 205. First through hole; 206. Second through hole;
3. Second air guide device, 31. First air guide section, 32. Second air guide section; 33. Division plate, 301. Air guide section, 302. Mounting groove;
4. Motor device;
5. Heating device;
6. Handle portion;
7. Control device;
8. Power switch;

DETAILED DESCRIPTION OF THE EMBODIMENTS

The embodiments of the present disclosure are described in details in this part, the better embodiments of the present disclosure are presented in the drawings, which are configured to supplement the description of the written part of the specification by figures, so that people can directly and vividly understand each technical feature and the whole technical solution, but not be understood as limitations to the present disclosure.

In the description of the present disclosure, it is understood that orientation or position relationships indicated by the terms "upper", "lower", "front", "rear", "left", and "right", and the like are based on the orientation or position relationships as shown in the drawings, for ease of describing the present disclosure and simplifying the description only, rather than indicating or implying that the mentioned apparatus or element necessarily has a particular orientation and must be constructed and operated in the particular orientation. Therefore, these terms should not be understood as limitations to the present disclosure.

In the description of the present disclosure, the meaning of "several" is one or more, the meaning of "a plurality" is more than two, "greater than", "less than", "exceeding" and the like are understood as excluding the original number, and "above", "below", "within" and the like are understood as including the original number. The described "first" and "second" are merely used for distinguishing technical features, instead of being understood as indicating or implying relative importance or impliedly indicating the quantity of the showed technical features of impliedly indicating the precedence relationship of the showed technical features.

In the description of the present disclosure, unless specific limitation otherwise, terms "set", "install", "join" and the like should be generally understood. Those of ordinary skill in the art may reasonably determine the specific meaning of the terms in the present disclosure in combination with the specific contents of the technical solution.

As shown in FIG. 1 to FIG. 6 and FIG. 11 to FIG. 13, preferably, an air outlet assembly, including a shell assembly 1, a first air guide device 2, a second air guide device 3 and a motor device 4, wherein a mounting cavity 105 is arranged inside the shell assembly 1, a first opening 101 is formed in the shell assembly 1, and the first opening 101 is communicated with the mounting cavity 105; the first air guide device 2 is arranged inside the mounting cavity 105 and provided with an air passing cavity 203, a second opening 201 and a third opening 202 are formed in the first air guide device 2, and the second opening 201 and the third opening 202 are communicated with the air passing cavity 203; at least a part of the second air guide device 3 stretches into the air passing cavity 203 of the first air guide device 2, one section that the second air guide device 3 stretches into the air passing cavity 203 is a first air guide section 31, a first air guide channel 102 is formed between the first air guide section 31 and an inner wall of the first air guide device 2, the second air guide device 3 stretches to one end away from the second opening 201, one section that the second air guide device 3 is located outside the first air guide device 2 is a second air guide section 32, an air passing channel 103 is formed between the second air guide section 32 of the second air guide device 3 and the shell assembly 1, the air passing cavity 203 is communicated with the air passing channel 103 through the second opening 201, the first opening 101 is located at one side, away from the first air guide device 2, of the second air guide device 3, the second air guide section 32 stretches to the first opening 101, an air outlet 104 is formed between the second air guide section 32 and a side wall of the first opening 101 of the shell assembly 1, and then the air outlet 104 is located at one side away from the first air guide section 31; and at least a part of the motor device 4 is arranged in the air passing cavity 203.

The present disclosure provides an air outlet assembly, the shell assembly 1 is provided with the air outlet 104, which is communicated with the mounting cavity 105 in the shell assembly 1; the first air guide device 2 is arranged in the mounting cavity 105 and provided with the air passing cavity 203, the second opening 201 and the third opening 202 are formed in the first air guide device 2 and communicated with the air passing cavity 203. External air reaches the air passing cavity 203 through the second opening 201 of the first air guide device 2 and then flows into the air passing channel 103 formed between the second air guide device 3 and the shell assembly 1 through the third opening 202 of the first air guide device 2, at least a part of the second air guide device 3 stretches into the air passing cavity 203 of the first air guide device 2, and the air passing channel 103 is formed between the second air guide device 3 and the shell assembly 1, so that the air flowing through the inside of the first air guide device 2 may be diffused to the air passing channel 103 well. The flowing air is gradually extruded, so as to form strong air pressure, the airflow is blown out through the air outlet 104 formed between the second air guide section 32 and the side wall of the shell assembly 1, the air blown from the air passing cavity 203 of the first air guide device 2 performs circumferential movement inside the shell assembly 1, and air supply and suction are carried out continuously at the same time, thereby forming uninterrupted high-pressure airflow for continuous supply. Further, through a specific shape setting of the air passing channel 103, the airflow may be guided and discharged after being intensively collected, so as to improve an air inlet efficiency. The airflow has a lower flow loss, so an air volume is improved, thereby implementing different speeds of a fluid in the air duct, adequately reducing the air volume at different positions, improving the air feeding effect and forming a high-pressure airflow for continuous supply.

Preferably, the width of the air outlet 104 is greater than 1.0 mm. In the above embodiment, the width of the air outlet 104 is greater than 1.0 mm for better air discharge.

Preferably, the width of the air outlet 104 is 2-3 mm.

As shown in FIG. 2 and FIG. 11 to FIG. 13, preferably, the second air guide device 3 is horn-shaped. Further, the second air guide device 3 may be horn-shaped for better concentrated and guided discharge of the airflow.

Preferably, the first air guide section 31 and the second air guide section 32 of the second air guide device 3 are enclosed to form the air guide section 301 around an axis, and a cross section area of the second air guide device 3 is gradually increased along a direction away from the first air guide device 2.

Preferably, the second air passing channel 204 is formed by the air passing cavity 203 of the first air guide device 2, the second opening 201 and the third opening 202.

Preferably, a radial size of the second air passing channel 204 is 18-55 mm.

Preferably, an axial size of the second air passing channel 204 is 3-140 mm.

Preferably, a length of the second air guide device 3 stretching to the second air passing channel 204 of the first air guide device 2 is 0-90 mm.

Figure 7:
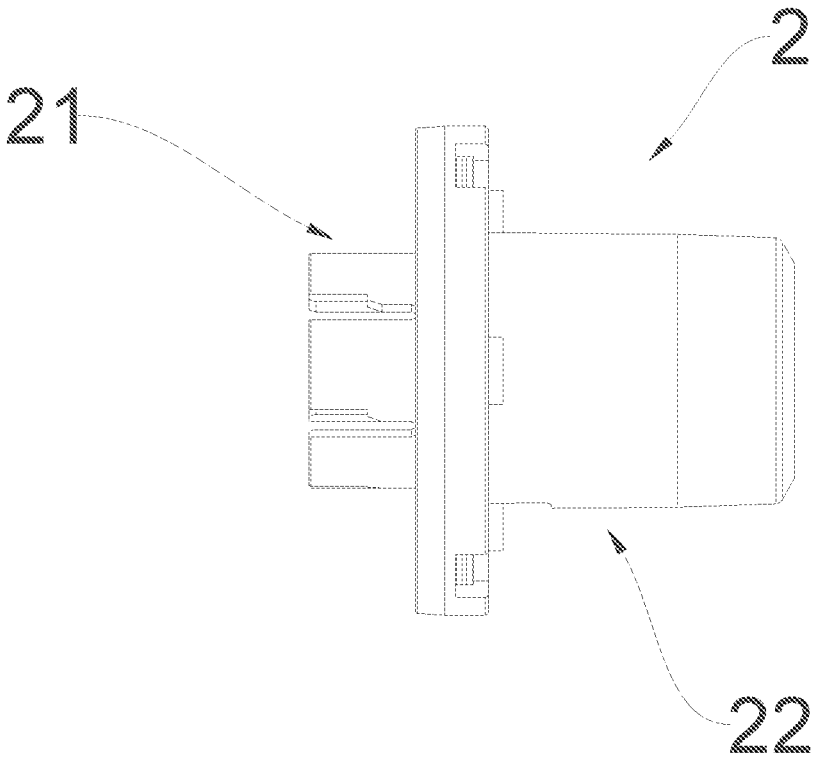
FIG. 7 is a front view of a first air guide device of the present disclosure.
Figure 8:
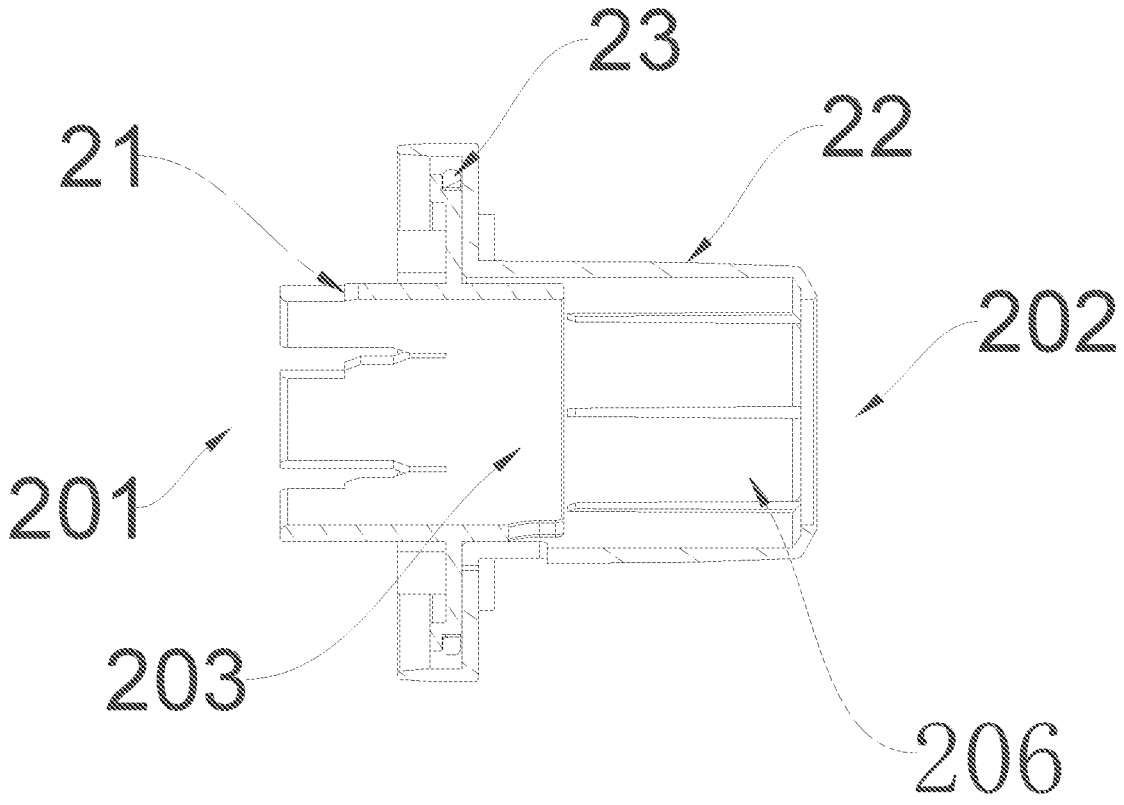
FIG. 8 is a profile of a first air guide device of the present disclosure.

As shown in FIG. 7 and FIG. 8, preferably, the first air guide device 2 includes an air guide member 21 and a connector 22, the air guide member 21 is arranged on the connector 22, the connector 22 is arranged on the shell assembly 1, a first through hole 205 is formed in the air guide member 21, a second through hole 206 is formed in the connector 22, and the first through hole 205 is communicated with the second through hole 206 in turn so as to form the air passing cavity 203. In the above embodiment, the air volume of the airflow flowing into the first air guide device 2 may be adequate.

Preferably, at least a part of the air guide member 21 stretches into the second through hole 206

Figure 2:
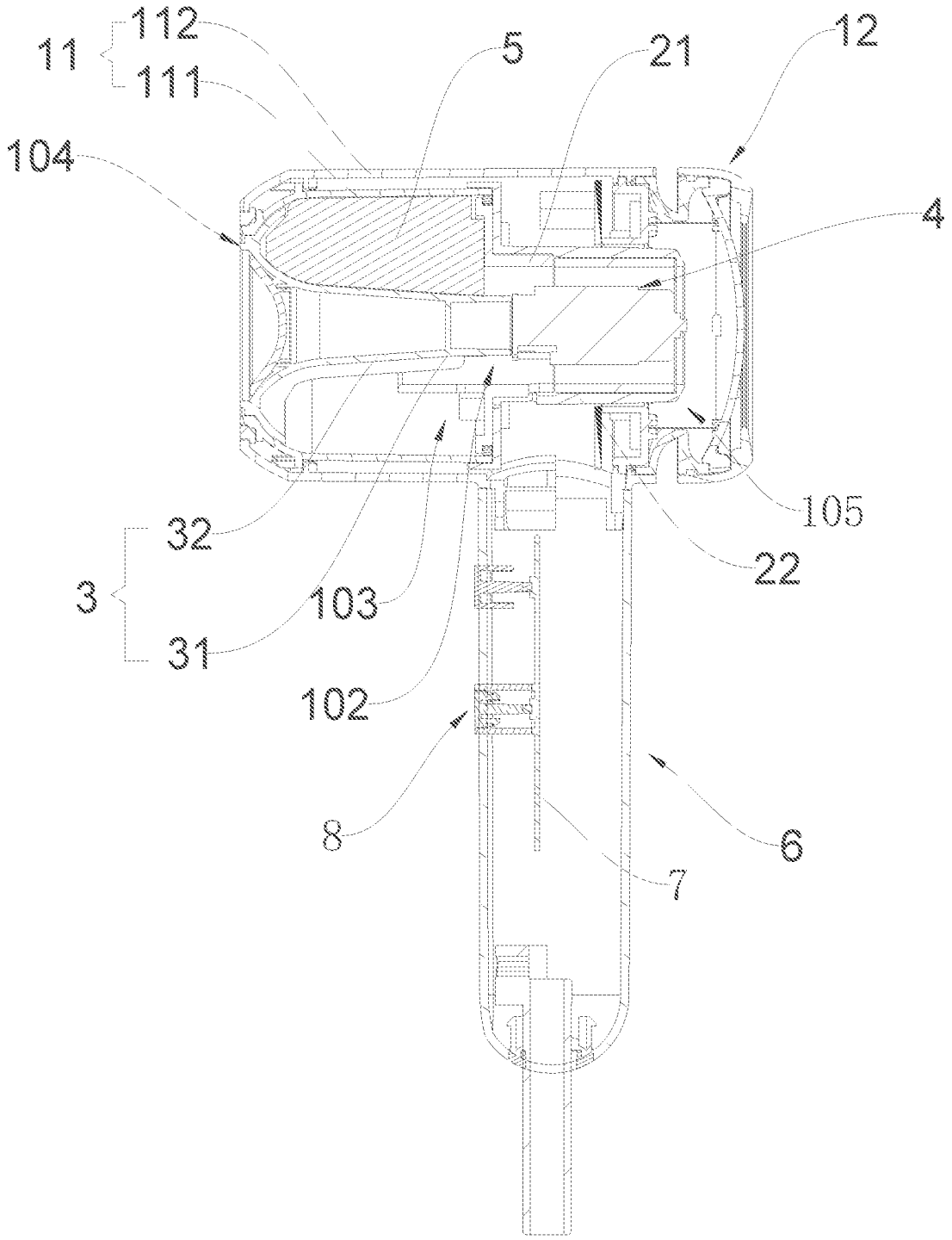
FIG. 2 is a profile of an electric hair drier of the present disclosure.

As shown in FIG. 2, preferably, the motor device 4 is located in the second through hole 206, one end of the motor device 4 resists to an inner wall of the connector 22, and the other end of the motor device 4 resists to the air guide member 21. In the above embodiment, the motor device 4 may apply the air pressure to the airflow entering the air guide member 21 well, so that airflow speed passing through the connector 22 and the air guide member 21 may be higher, and the flowing speed is smoother.

Figure 9:
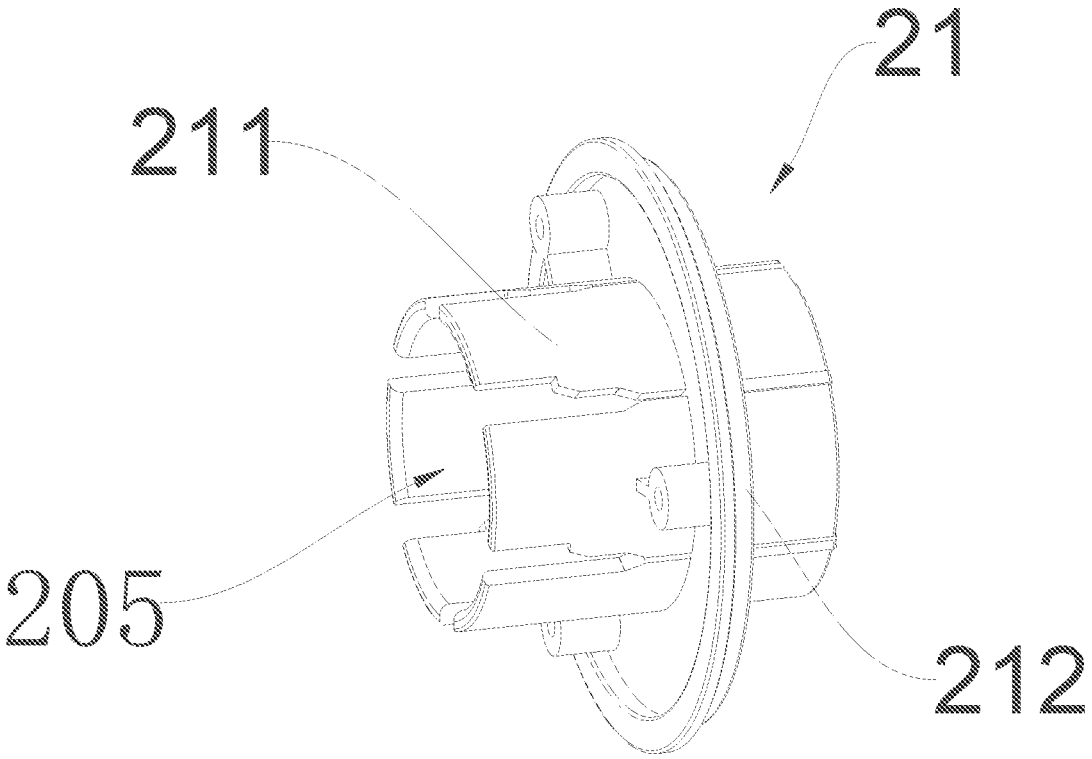
FIG. 9 is a solid diagram of an air guide member of the present disclosure.

As shown in FIG. 9, preferably, the air guide member 21 includes an air guide member main body 211 and a first mounting member 212, the first mounting member 212 is arranged around the air guide member main body 211, the air guide main body 211 stretches into the second through hole 206, and the first through hole 205 is formed in the air guide member main body 211. In the above embodiment, the flowing airflow may be transmitted well, so as to ensure the maximum airflow.

Figure 10:
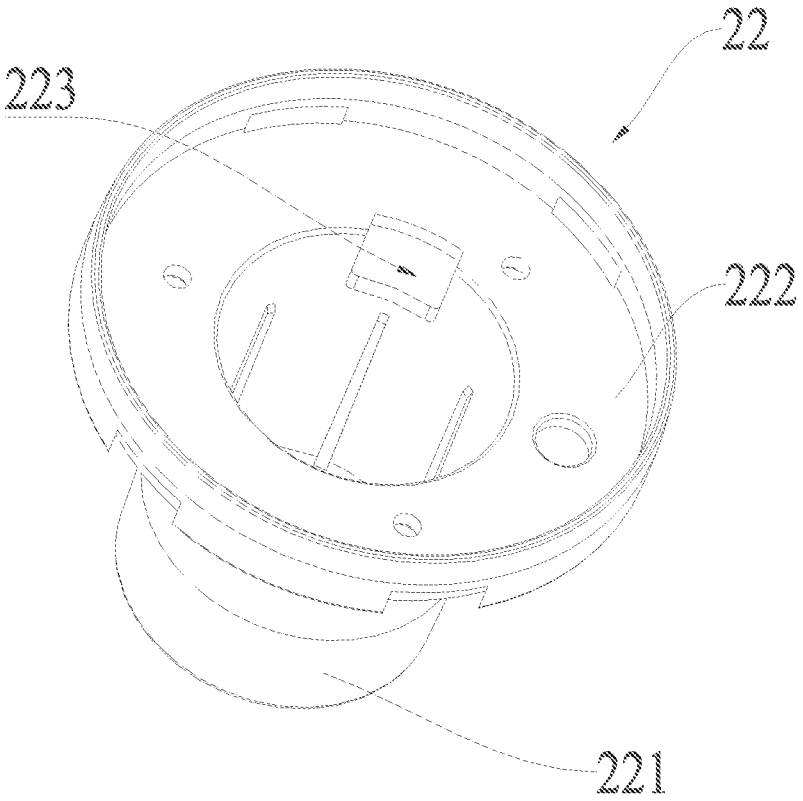
FIG. 10 is a solid diagram of a connector of the present disclosure.
Figure 11:
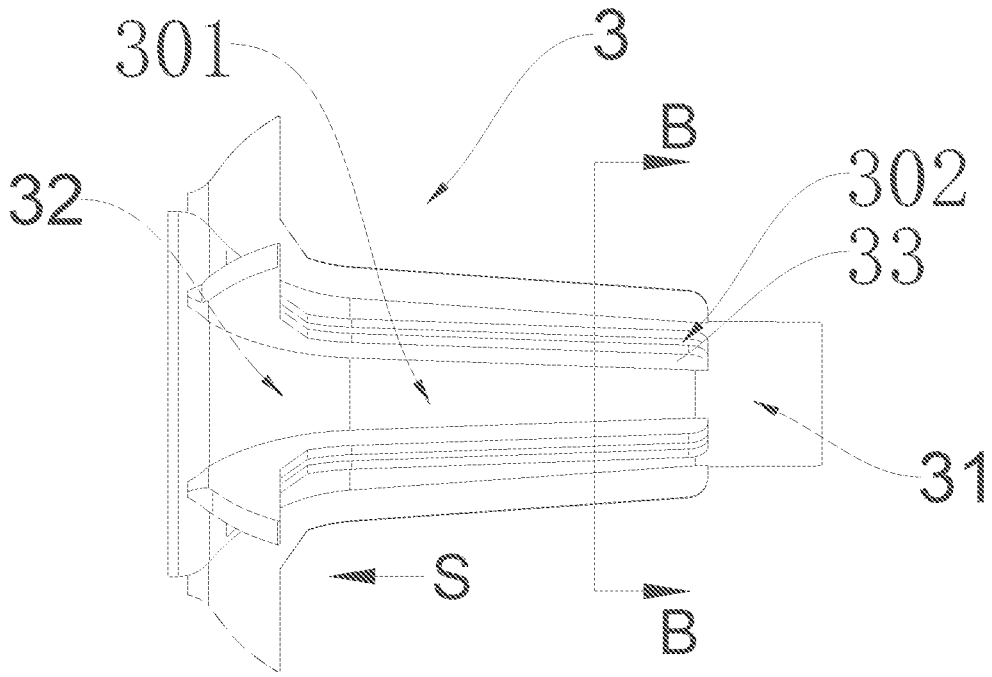
FIG. 11 is a front view of a second air guide device of the present disclosure.
Figure 12:
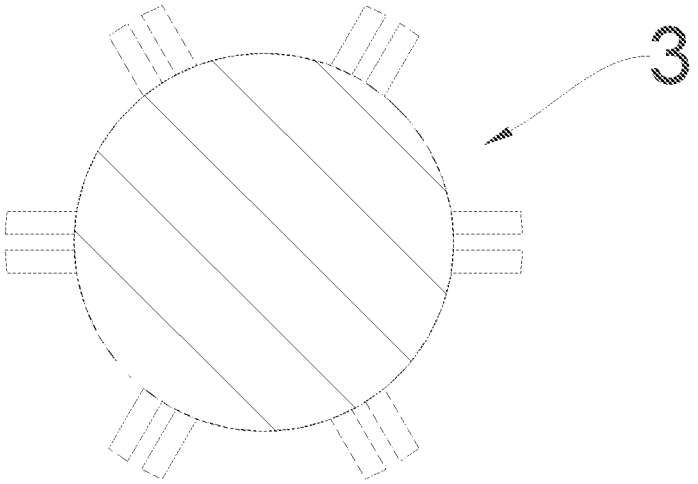
FIG. 12 is a profile of FIG. 11 in a B-B direction.
Figure 13:
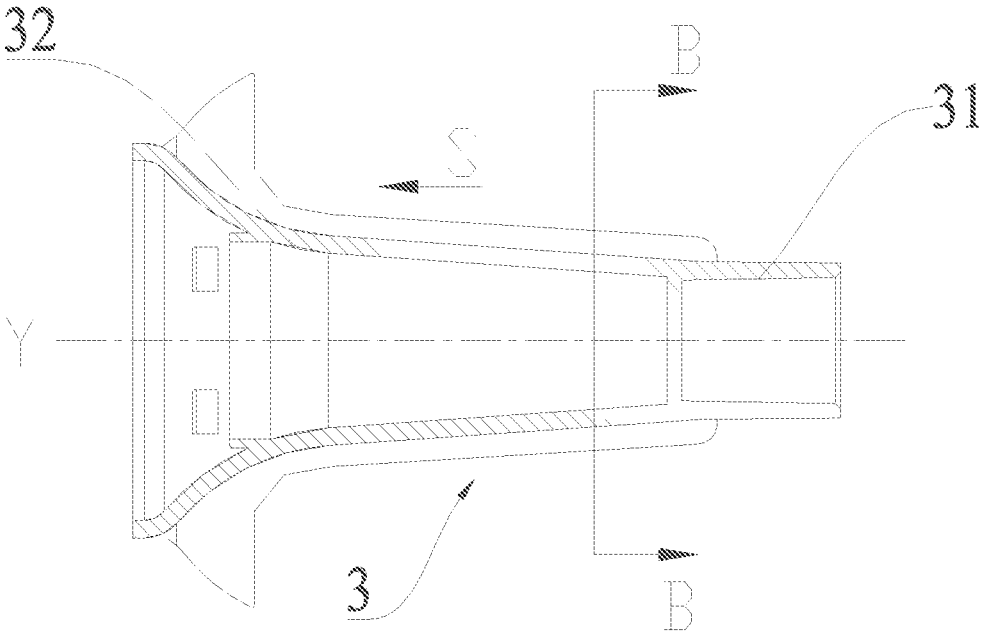
FIG. 13 is a profile of a second air guide device of the present disclosure.

As shown in FIG. 10, preferably, the connector 22 includes a connector main body 221 and a second mounting member 222, the second through hole 206 is formed in the connector main body 221, at least a part of the air guide member 21 stretches into the second through hole 206, the second mounting member 222 is arranged on the connector main body 221, and the second mounting member 222 is connected to the shell assembly 1. In the above embodiment, the flowing airflow be transmitted well, so as to ensure the maximum airflow.

Figure 3:
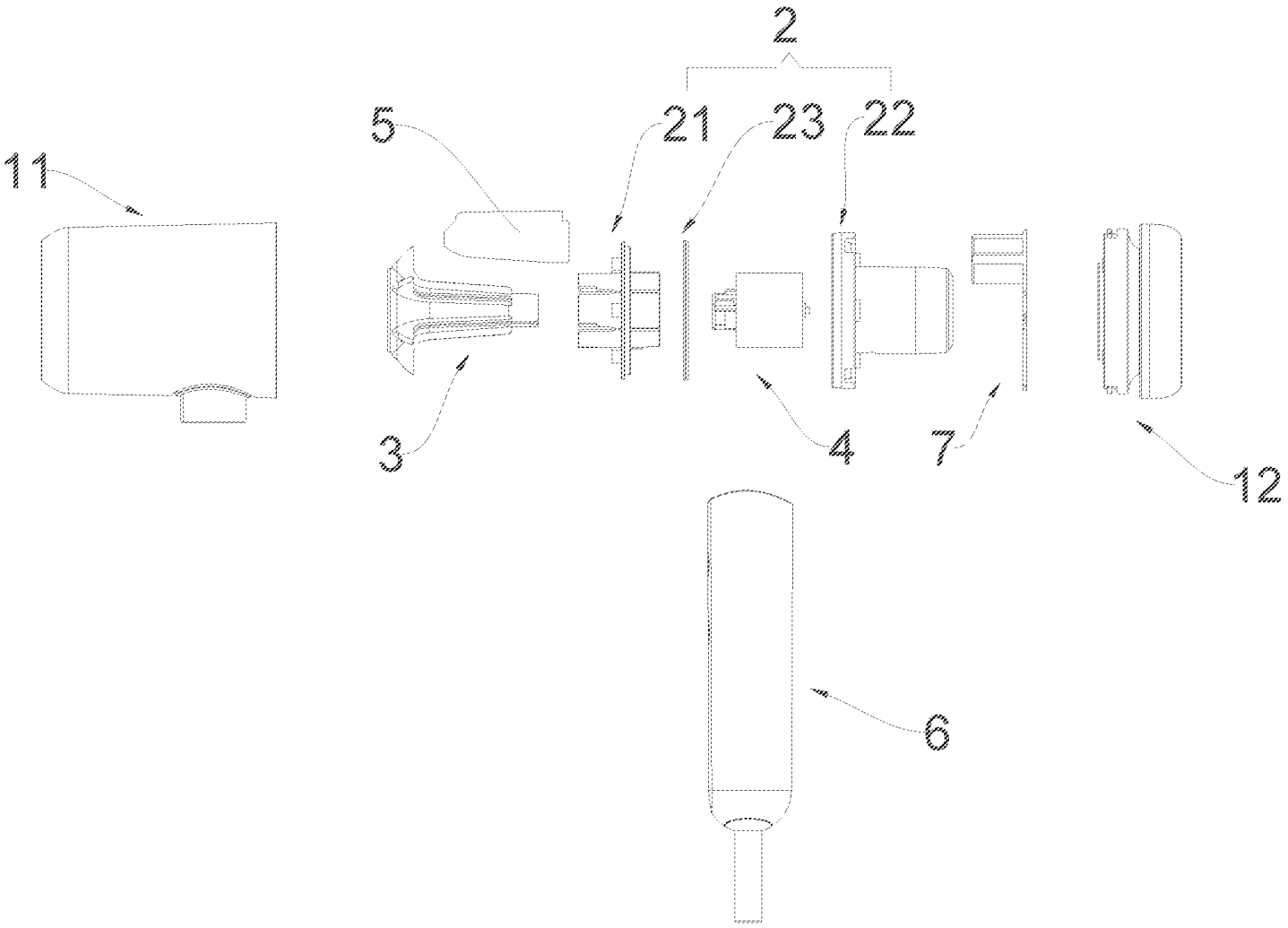
FIG. 3 is an exploded view of an electric hair drier of the present disclosure.
Figure 4:
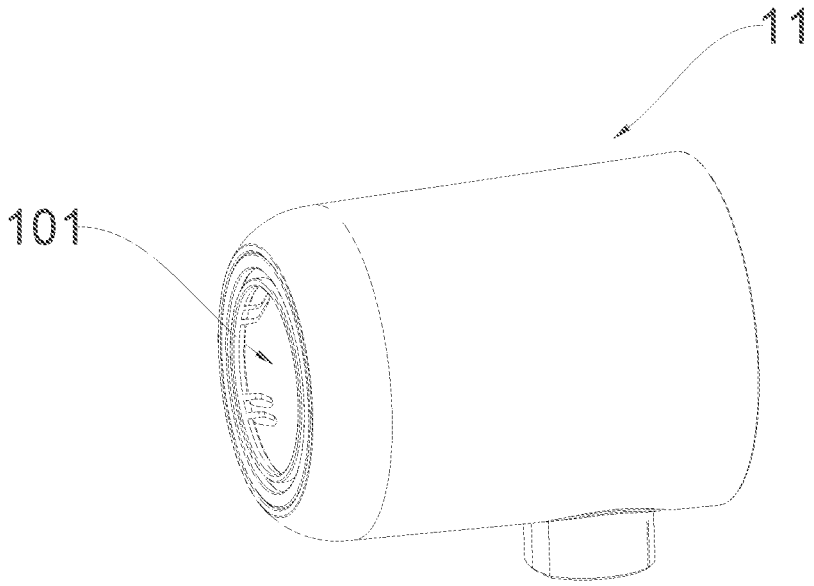
FIG. 4 is a solid diagram of an air outlet shell assembly of the present disclosure.
Figure 5:
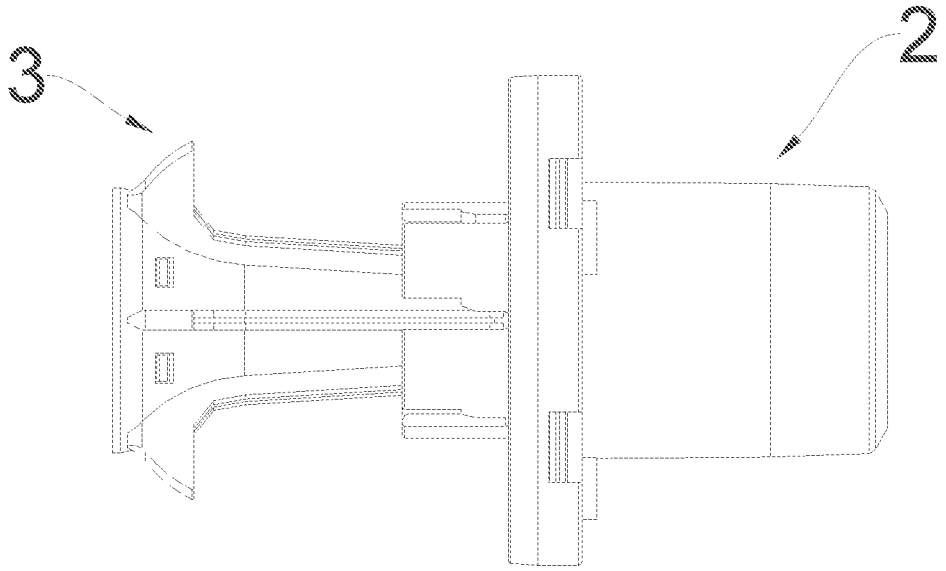
FIG. 5 is a front view of a first air guide device and a second air guide device of the present disclosure.
Figure 6:
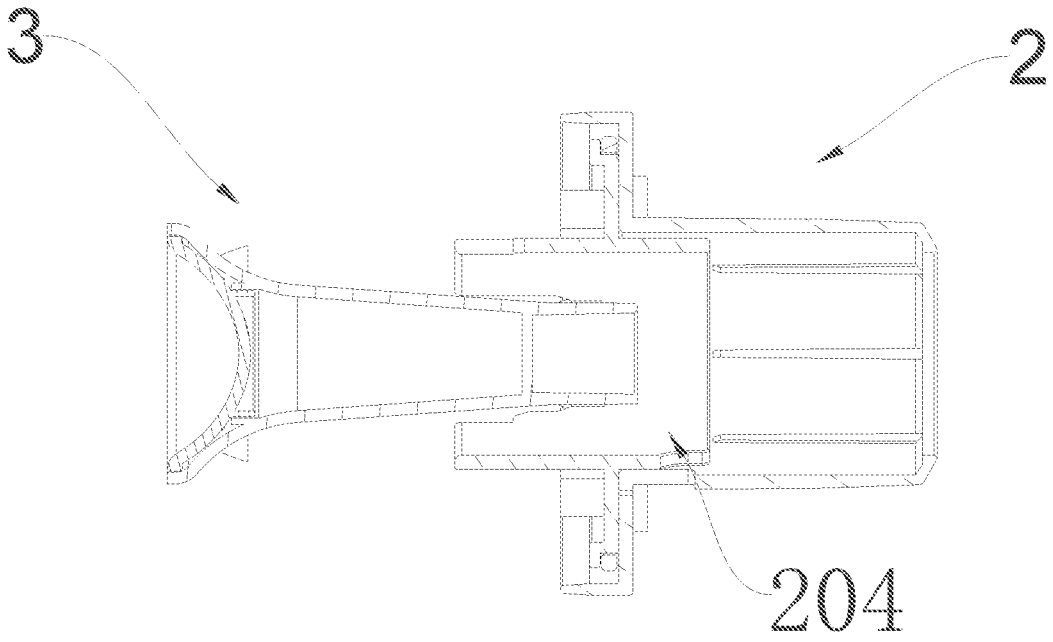
FIG. 6 is a profile of a first air guide device and a second air guide device of the present disclosure.

As shown in FIG. 1 to FIG. 3, preferably, according to a second aspect, the embodiment of the present disclosure provides an electric hair drier, including an air outlet assembly, a heating device 5, a control device 7, a handle portion 6 and a power switch 8, wherein the shell assembly 1 includes an air outlet shell assembly 11 and an air inlet shell assembly 12, the air outlet shell assembly 11 is connected to the air outlet shell assembly 12, and the air outlet shell assembly 11 and the air inlet shell assembly 12 are enclosed to form a mounting cavity; the heating device 5 is arranged on a second air guide device 3 and located between the second air guide device 3 and the shell assembly 1; the control device 7 is electrically connected to a motor device 4 and the heating device 5; and the handle portion 6 is connected to the shell assembly 1, the power switch 8 is arranged on the handle portion 6, and the power switch 8 is electrically connected to the control device 7.

The present disclosure provides an electric hair drier, including an air outlet assembly, wherein the shell assembly 1 includes an air outlet shell assembly 11 and an air inlet shell assembly 12, and the air outlet shell assembly 11 is connected to the air inlet shell assembly 12 to form the mounting cavity 105 and a channel, through which the airflow can flow. The heating device 5 is arranged on the second air guide device and located between the second air guide device and the shell assembly, and the heating device is configured to heat the air flowing through the air passing channel.

Further, a plurality of heating devices 5 are provided and arranged at intervals, a radial end of each heating device 5 is embedded with a first mounting gap and/or a second mounting gap, the air of the motor device 4 may be blown to the heating device 5 or other components by using a structure inside the heating device, thereby achieving temperature reduction and noise reduction well.

Further, a plurality of division plates 33 are arranged on the second air guide device 3, the plurality of division plates 33 are arranged at intervals, mounting grooves 302 are formed in the plurality of division plates 33, and the heating devices 5 are arranged on the mounting grooves 302.

The control device 7 is arranged in a containing cavity, and the control device 7 is electrically connected to the motor device 4, so as to realize automation well. The electric hair drier further includes a handle portion 6 and a power switch 8, the handle portion 6 is connected to the shell assembly 1, the power switch 8 is arranged on the handle portion 6, and the power switch 8 is electrically connected to the control device 7.

In the above embodiment, the electric hair drier further includes a handle portion 6 and a power switch 8, the handle portion 6 is connected to the shell assembly 1, the power switch 8 is arranged on the handle portion 6, and the power switch 8 is electrically connected to the control device 7. The automation and fetching and using through the handle portion 6 may be achieved well.

As shown in FIG. 2, further, the air outlet shell assembly 11 includes a first shell assembly 111 and a second shell assembly 112, the second shell assembly 112 is sleeved on the first shell assembly 111, the heating device 5 is located between the second air guide device 3 and the first shell assembly 111, and the second shell assembly 112 is made of thermal insulation materials or the thermal insulation materials are coated on the second shell assembly 112.

Each technical feature of the above embodiments may be combined freely. For simplicity of description, not all possible combinations of each technical solution in the above embodiments are described. However, any combination of these technical features shall fall within the scope recorded in the specification without conflicting.

The above embodiments only express some implementation modes of the present disclosure and are specifically described in detail and not thus understood as limits to the patent scope of the present disclosure. It is to be pointed out that those of ordinary skill in the art may further make a plurality of transformations and improvements without departing from the concept of the present disclosure and all of these fall within the scope of protection of the present disclosure. Therefore, the scope of patent protection of the present disclosure should be subject to the appended claims.

What is claimed is:

1. An air outlet assembly, comprising:

a shell assembly (1), wherein a mounting cavity (105) is arranged inside the shell assembly (1), a first opening (101) is formed in the shell assembly (1), and the first opening (101) is communicated with the mounting cavity (105);

a first air guide device (2), wherein the first air guide device (2) is arranged inside the mounting cavity (105), the mounting cavity (105) is divided into two parts through the first air guide device (2), the first air guide device (2) is provided with an air passing cavity (203), a second opening (201) and a third opening (202) are formed in the first air guide device (2), the second opening (201) and the third opening (202) are communicated with the air passing cavity (203);

and one part of the mounting cavity (105) is communicated with another part of the mounting cavity (105) after passing through the second opening (201), the air passing cavity (203) and the third opening (202);

a second air guide device (3), wherein at least a part of the second air guide device (3) stretches into the air passing cavity (203) of the first air guide device (2) through the second opening (201), one section that the second air guide device (3) stretches into the air passing cavity (203) is a first air guide section (31), a first air guide channel (102) is formed between the first air guide section (31) and an inner wall of the first air guide device (2), the second air guide device (3) stretches to one end away from the second opening (201), one section that the second air guide device (3) is located outside the first air guide device (2) is a second air guide section (32), an air passing channel (103) is formed between the second air guide section (32) of the second air guide device (3) and the shell assembly (1), the air passing cavity (203) is communicated with the air passing channel (103) through the second opening (201), the first opening (101) is located at one side, away from the first air guide device (2), of the second air guide device (3), the second air guide section (32) stretches to the first opening (101), an air outlet (104) is formed between the second air guide section (32) and a side wall of the shell assembly (1), and then the air outlet (104) is located at one side away from the first air guide section (31); and a motor device (4), wherein the motor device (4) is arranged in relative to the third opening (202) or at least a part of the motor device (4) is located in the air passing cavity (203), and the motor device (4) is configured to generate airflow towards the second opening (201) from the third opening (202);

wherein the first air guide section (31) and the second air guide section (32) of the second air guide device (3) are enclosed to form an air guide section (301) around an axis, and a cross section area of the second air guide device (3) is gradually increased along a direction (S) away from the first air guide device (2).

2. The air outlet assembly according to claim 1, wherein a width of the air outlet is greater than 1.0 mm and the second air guide device is horn-shaped.

3. The air outlet assembly according to claim 1, wherein the second air passing channel (204) is formed by the air passing cavity (203) of the first air guide device (2), the second opening (201) and the third opening (202).

4. The air outlet assembly according to claim 3, wherein a radial size of the second air passing channel (204) is 18-55 mm; and/or an axial size of the second air passing channel (204) is 3-140 mm; and/or a length of the second air guide device (3) stretching to the second air passing channel (204) of the first air guide device (2) is 0-90 mm.

5. The air outlet assembly according to claim 1, wherein the first air guide device (2) comprises an air guide member (21) and a connector (22), the air guide member (21) is arranged on the connector (22), the connector (22) is arranged on the shell assembly (1), a first through hole (205) is formed in the air guide member (21), a second through hole (206) is formed in the connector (22), and the first through hole (205) is communicated with the second through hole (206) in turn so as to form the air passing cavity (203).

6. The air outlet assembly according to claim 5, wherein the motor device (4) is located in the second through hole (206), one end of the motor device (4) resists to an inner wall of the connector (22), and another end of the motor device (4) resists to the air guide member (21).

7. The air outlet assembly according to claim 5, wherein the air guide member (21) comprises an air guide member main body (211) and a first mounting member (212), the first mounting member (212) is arranged around the air guide member main body (211), the air guide main body (211) stretches into the second through hole (206), and the first through hole (205) is formed in the air guide member main body (211); and/or the connector (22) comprises a connector main body (221) and a second mounting member (222), the second through hole (206) is formed in the connector main body (221), at least a part of the air guide member (21) stretches into the second through hole (206), the second mounting member (222) is arranged on the connector main body (221), and the second mounting member (222) is connected to the shell assembly (1).

8. An electric hair drier, comprising:

an air outlet assembly according to any one of claim 1, the shell assembly (1) comprises an air outlet shell assembly (11) and an air inlet shell assembly (12), the air outlet shell assembly (11) is connected to the air outlet shell assembly (12), and the air outlet shell assembly (11) and the air inlet shell assembly (12) are enclosed to form a mounting cavity (105);

a heating device (5), which is arranged on a second air guide device (3) and located between the second air guide device (3) and the shell assembly (1);

a control device (7), which is electrically connected to a motor device (4) and the heating device (5); and a handle portion (6) and a power switch (8), wherein the handle portion (6) is connected to the shell assembly (1), the power switch (8) is arranged on the handle portion (6), and the power switch (8) is electrically connected to the control device (7).

* * * * *